US010323830B2

(12) United States Patent
Adams, IV et al.

(10) Patent No.: US 10,323,830 B2
(45) Date of Patent: Jun. 18, 2019

(54) BULB GRIPPER FOR HOLDING DECORATIVE LIGHTS

(71) Applicant: Adams Mfg. Corp., Portersville, PA (US)

(72) Inventors: William E. Adams, IV, Harmony, PA (US); Matthew Goodworth, Pittsburgh, PA (US); Kevin A. Harper, Mason, OH (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 15/856,627

(22) Filed: Dec. 28, 2017

(65) Prior Publication Data

US 2018/0187867 A1 Jul. 5, 2018

Related U.S. Application Data

(60) Provisional application No. 62/440,122, filed on Dec. 29, 2016.

(51) Int. Cl.

| | |
|---|---|
| ***F21V 17/16*** | (2006.01) |
| ***F21V 21/08*** | (2006.01) |
| ***F21V 21/088*** | (2006.01) |
| ***F21S 4/10*** | (2016.01) |
| ***F21V 17/02*** | (2006.01) |
| *F21W 121/00* | (2006.01) |

(52) U.S. Cl.

CPC ..... *F21V 17/16* (2013.01); *F21S 4/10* (2016.01); *F21V 17/02* (2013.01); *F21V 21/088* (2013.01); *F21V 21/0824* (2013.01); *F21W 2121/004* (2013.01)

(58) Field of Classification Search

CPC ..... F21V 17/16; F21V 17/02; F21V 21/0824; F21V 21/088; F21W 2121/004; F21S 4/10

See application file for complete search history.

(56) References Cited

U.S. PATENT DOCUMENTS

| | | | | |
|---|---|---|---|---|
| 4,851,977 | A | 7/1989 | Gary | |
| 4,901,212 | A | 2/1990 | Prickett | |
| 4,905,131 | A | 2/1990 | Gary | |
| D331,360 | S | 12/1992 | Adams | |
| 5,249,108 | A | 9/1993 | Gary | |
| 5,469,344 | A | 11/1995 | Kotsakis | |
| 5,581,956 | A | 12/1996 | Fennessy et al. | |
| 5,632,552 | A * | 5/1997 | Wang | F21V 21/08 362/396 |

(Continued)

*Primary Examiner* — David V Bruce

(74) *Attorney, Agent, or Firm* — Buchanan Ingersoll & Rooney PC

(57) ABSTRACT

A bulb gripper for decorative light holder has a U-shaped body with projections on the interior surface that enable the bulb gripper to securely hold many different sizes of decorative light bulbs. The interior surface of each arm of the body has an inward tooth near the opening followed by several three spaced apart projections. The projections may have a tab portion which is connected to the arm by a narrower connector. The projections and the teeth on the arms form a ledge which supports the decorative light. A smaller U-shaped projection or several projections which are sized and configured to hold a mini-light are provided at the base of the U-shaped body. The arms can flex outward so that the body can receive and securely hold the decorative light.

7 Claims, 9 Drawing Sheets

(56) References Cited

U.S. PATENT DOCUMENTS

| | | | |
|---|---|---|---|
| 5,667,174 | A | 9/1997 | Adams |
| 5,669,709 | A | 9/1997 | Adams |
| 5,772,166 | A | 6/1998 | Adams |
| 6,328,459 | B1 | 12/2001 | Adams |
| 8,888,337 | B2 | 11/2014 | Adams, IV et al. |
| D756,764 | S | 5/2016 | Limber |

* cited by examiner

BULB GRIPPER FOR HOLDING DECORATIVE LIGHTS

CROSS-REFERENCE TO RELATED APPLICATION

Applicants claim the benefit of U.S. Provisional Patent Application Ser. No. 62/440,122 filed Dec. 29, 2016.

FIELD OF THE INVENTION

This invention relates to clips and stakes for displaying decorative lights.

DESCRIPTION OF THE PRIOR ART

Decorative lights typically consist of a large number of light sockets being wired together with light bulbs positioned in the light sockets. The string of lights is then attached to the face of a building, mounted on stakes, wrapped around a tree or hung on a seasonal display. Strings of lights have been mounted by retaining either the light socket or the wire. The object of these holders is to display the lights so that they can easily be seen. The holders must not be adversely affected by cold temperatures and should be able to hold the lights during high winds which commonly accompany winter storms.

For many years Christmas lights were sold in three sizes: mini, standard (C7) and outdoor (C9). However, in recent years LED lights have become available that differ somewhat in size from their incandescent counterpart and created new sizes called C4, C5, C6, C12 and G28. Furthermore, the socket can also vary in size depending upon the manufacturer. A decorative light holder should be capable of holding all these sizes of light bulbs.

U.S. Pat. No. 5,667,174 discloses a stake having a light holder for holding decorative lights. The light holder has an S-shaped bulb gripper portion. One end of the bulb gripper has a small opening for holding a mini-light and the other end has a larger opening for holding a C7 or a C9 light. The bulb gripper is made of a resilient material so that the distal end and the proximate end can be sufficiently spread apart to receive a decorative light socket and then close to grasp the socket.

U.S. Pat. No. 5,669,709 discloses a decorative light holder having an S-shaped bulb gripper that can be attached to a gutter or shingles. In the preferred embodiment shown in FIG. 4 of the patent one half of the S-shape is sized to hold a mini-light socket and the other half is larger and sized to hold the standard C7 and outdoor C9 sockets.

U.S. Pat. No. Des. 331,360 discloses a hook for supporting Christmas lights adjacent roofing shingles. This hook is comprised of a small stake which fits between the shingles having a single spiral at one end. The spiral end is sized to hold the wire of the Christmas light string, not a bulb or socket. Similar devices comprised of a stake or straight pin with a curved holder attached at one end have been used to retain other structures or products.

Another prior art device provides an L-shaped light support bracket with one of the legs being fitted under a shingle. The other leg includes a hole sized to receive a light bulb. This type of light support bracket can also be positioned within a retaining strip which is permanently attached to a flat building surface. Examples of these light mountings are shown in U.S. Pat. Nos. 4,905,131; 4,901,212; and 4,851,977; and have been sold under the trademark "LITES UP" by Gary Products Group, Inc.

Yet another type of decorative light holder has a U-shaped clip which receives the socket of a decorative light. This type of bulb gripper typically cannot securely hold a mini-light, or a C7 light or a C9 light.

U.S. Pat. No. 5,469,344 discloses a support for holding a string of decorative lights on a building. The support consists of a series of elongate members that are connected together. Each elongate member has one or more circular openings. Flanges are provided on the interior of each of the openings to frictionally engage the light bulb. Because the openings are a fixed diameter they can hold only one size light bulb.

There is a need for a holder for decorative lights that can hold all sizes of decorative lights securely. This holder should not allow the decorative light being held to move relative to the holder.

SUMMARY OF THE INVENTION

We provide a decorative light holder which can securely hold a decorative light ranging in size from mini-light bulbs to the largest currently available decorative light that is in a string of decorative lights. Those sizes which are larger than a mini-light include C7 and C9 as well as C4, C5, C6, C12 and G28.

Our decorative light holder has a bulb gripper containing a U-shaped body with projections on the interior surface that enable the bulb gripper to securely hold these many different sizes of decorative light bulbs.

One embodiment has two arms attached to a base that form a U-shaped body. The interior surface of each arm of the body has an inward tooth near the opening followed by three spaced apart projections. A smaller U-shaped projection is at the base of the body. This smaller U-shaped projection is sized to hold a mini-light. The arms can flex outward so that the body can receive and securely hold the decorative light.

A second embodiment also has a U-shaped body consisting of two arms attached to a base. This embodiment is similar to the first embodiment but has projections at the base of the U-shaped body which are sized and configured to hold a mini-light.

The projections and the teeth on the arms form a ledge which supports the decorative light. When holding a C7, C9, C4, C5, C6, C12 or G28 decorative light this ledge should be in the gap that is formed by the top of the light socket and the portion of the light bulb adjacent the top of the light socket. The ledge prevents the light from moving up or down as well as prevents the light bulb from tilting. Consequently, a string of lights can be displayed such that all of the light bulbs are within a common plane and all oriented in the same way.

Traditional decorative light holders have held the middle or base of the light socket. In those holders the bulb can slide up and down as nothing locks them in vertically. The bulb gripper disclosed here takes a different approach and engages the decorative light at the top of the socket and the neck of the bulb, except for mini-lights which do not has a narrower neck.

Other features and advantages of our bulb gripper for holding a decorative light will become apparent from certain preferred embodiments which are shown in the drawings.

DESCRIPTION OF THE PREFERRED EMBODIMENTS

We provide a bulb gripper for a decorative light holder which has a U-shaped body with projections on the interior surface that enable the bulb gripper to securely hold a mini-light, or a C7 light or a C9 light as well as the newer C4, C5, C6, C12 and G28 sizes. This bulb gripper can be on a stake or attached to a housing that enables the bulb gripper to be attached to a gutter, siding, shingles or other structures.

Figure 1:
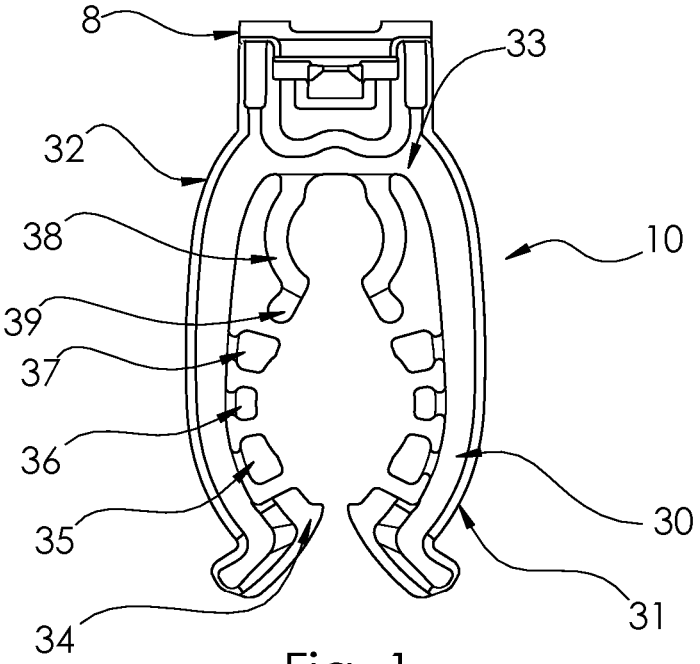
FIG. 1 is top view of a present preferred embodiment of our bulb gripper for a decorative light holder.

A first present preferred embodiment of our bulb gripper is shown in FIG. 1. The bulb gripper 10 has two arms 31, 32 attached to a base 33 that together form a U-shaped body 30. The U-shaped body is attached to a stake or housing which is used to place the decorative light at a desired location. The interior surface of each arm of the body has an inward tooth 34 near the opening followed by three spaced apart projections 35, 36, 37. A smaller U-shaped projection 38 is at the base of the body. This smaller U-shaped projection 38 is sized to hold a mini-light. Because a mini-light has a bulb which is straight, the U-shaped projection is intended to grip mini lights by the socket and C3, C4, C5, and some smaller diameter C6 lights at the neck. The flats 39 at the ends of the U-shaped projection, along with tooth 34 and three projections 35, 36, 37 on each arm 31, 32 define a circular opening that is sized to receive and securely hold the socket of a C7 light. The arms can flex outward so that the body can receive and securely hold the socket containing a C9, C12 or new G-sized decorative light.

Figure 7:
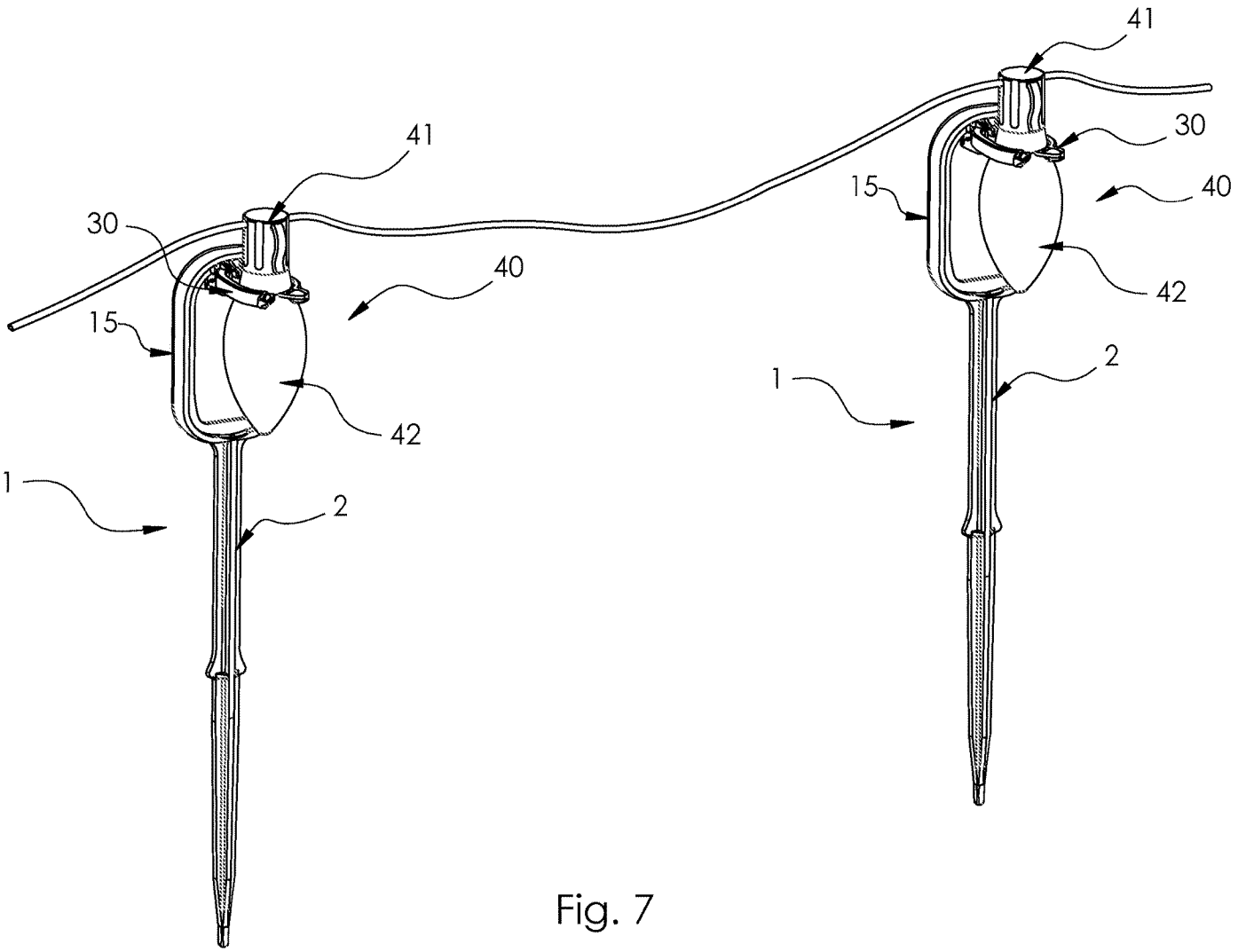
FIG. 7 is perspective view of two of the stakes shown in FIGS. 4 and 5 holding a portion of a string of decorative lights with the bulb portion of the light bulbs being held above the bulb gripper.
Figure 8:
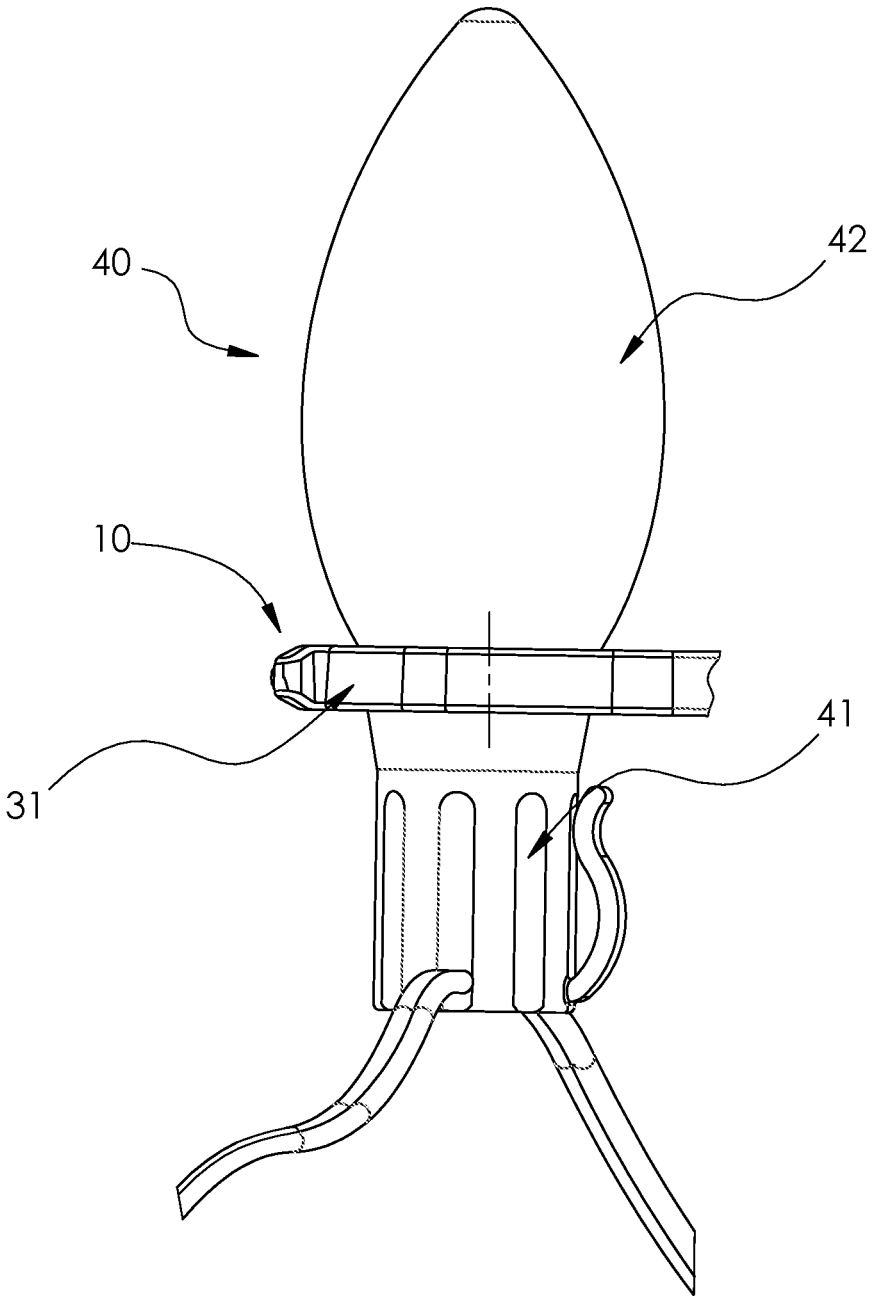
FIG. 8 is a side view of a decorative light being held by a portion of the bulb gripper as in FIG. 7.
Figure 9:
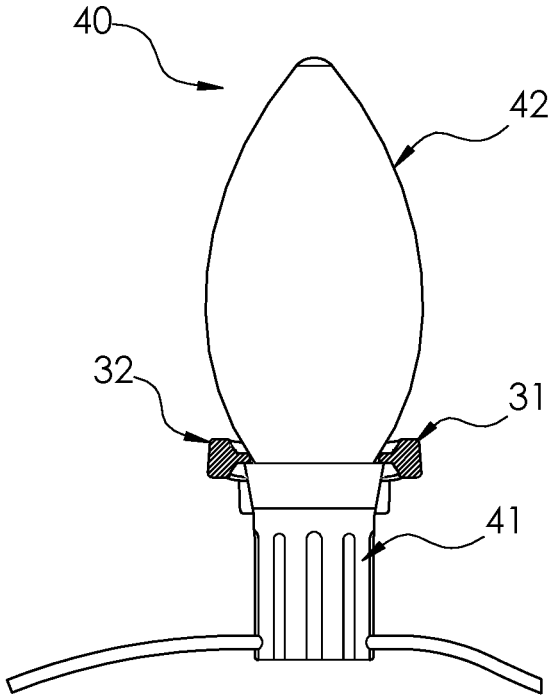
FIG. 9 is a sectional view taken along the line IX-IX in FIG. 8.

In recent years LED lights have become available that differ somewhat in size from their incandescent counterparts and are sold in new sizes called C4, C5 and C6. Furthermore, the socket can also vary in size depending upon the manufacturer. The bulb gripper disclosed here can be used to securely hold traditional decorative lights as well as the newer sizes of LED decorative lights. As can be seen in FIGS. 8 and 9, the bulb gripper 10 engages the decorative light 40 just above the top of the socket 41 and the neck of the bulb 42, except for mini-lights which do not have a narrower neck. The projections 35, 36, 37 on each arm 31, 32 that project inward from the U-shaped body of the bulb gripper are thin and form a ledge which supports the decorative light and prevents the light from moving up or down. The ledge helps the arms securely hold the light bulb in an upright vertical position shown in FIG. 7 and assures that all of the lights bulbs in a set are held the same position. The projections 35, 36, 37 that form the ledge may be mid-way between the top surfaces and the bottom surfaces of the arms or close to either the top surfaces or the bottom surfaces of the arms. Alternatively, the ledge may be formed by a single projection on each arm rather than multiple projections on each arm as shown in the drawings.

Figure 2:
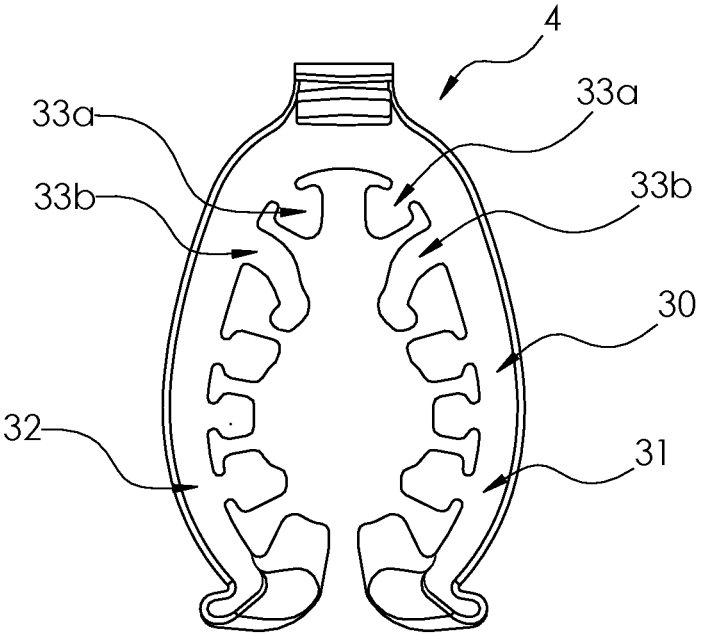
FIG. 2 is a top view of a second present preferred embodiment of our bulb gripper for a decorative light holder.

A second present preferred embodiment 4 of the bulb gripper is shown in FIG. 2. This embodiment is similar to the first embodiment but has projections 33*a* and 33*b* at the base of the U-shaped body 30. These projections are sized and configured to hold a mini-light.

Figure 3:
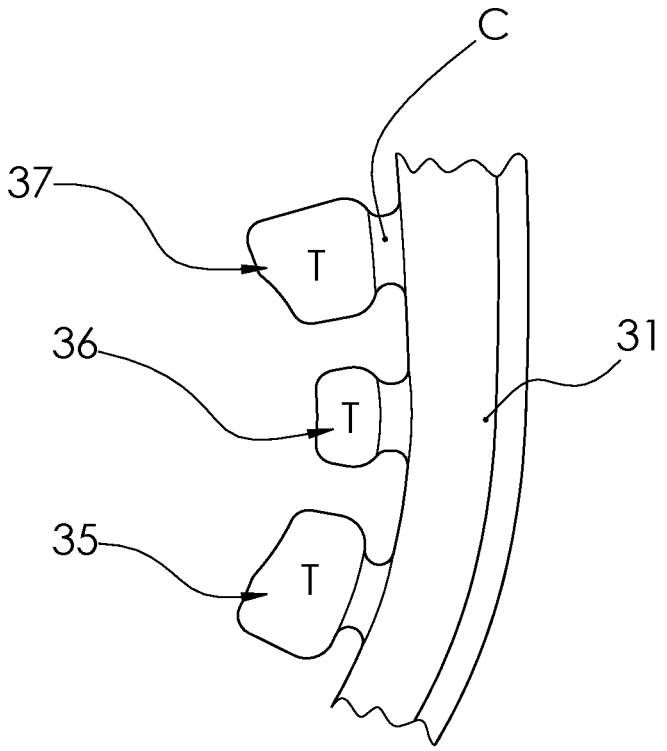
FIG. 3 is an enlarged view of a portion of the one arm of the embodiment shown in FIG. 1.

As can be seen most clearly in FIG. 3, the projections 35, 36, and 37 as well as projections 33*a* seen in FIG. 2 each preferably consists of a tab portion T connected to the arm 31, 32 by a narrower connector portion C. When a decorative light bulb is inserted into the bulb gripper the narrower connector enables the tab to flex up or down without causing the arm to twist. This is a significant improvement over a bulb gripper in which the projections are replaced by a continuous ledge or a continuous ledge having spaced apart slots like the flanges disclosed in U.S. Pat. No. 5,469,344. The continuous ledge becomes essentially a support rib which makes it too hard for users to push a bulb into the gripper. Furthermore, the arms may twist as the light bulb is inserted. Putting slots in the ledge is only partially effective in reducing rigidity and will not eliminate the twisting or distortion problem that may be encountered when the bulb is inserted between the arms. Also, adding slots would create stress concentrations at the ends of the slots between the flanges.

Figure 4:
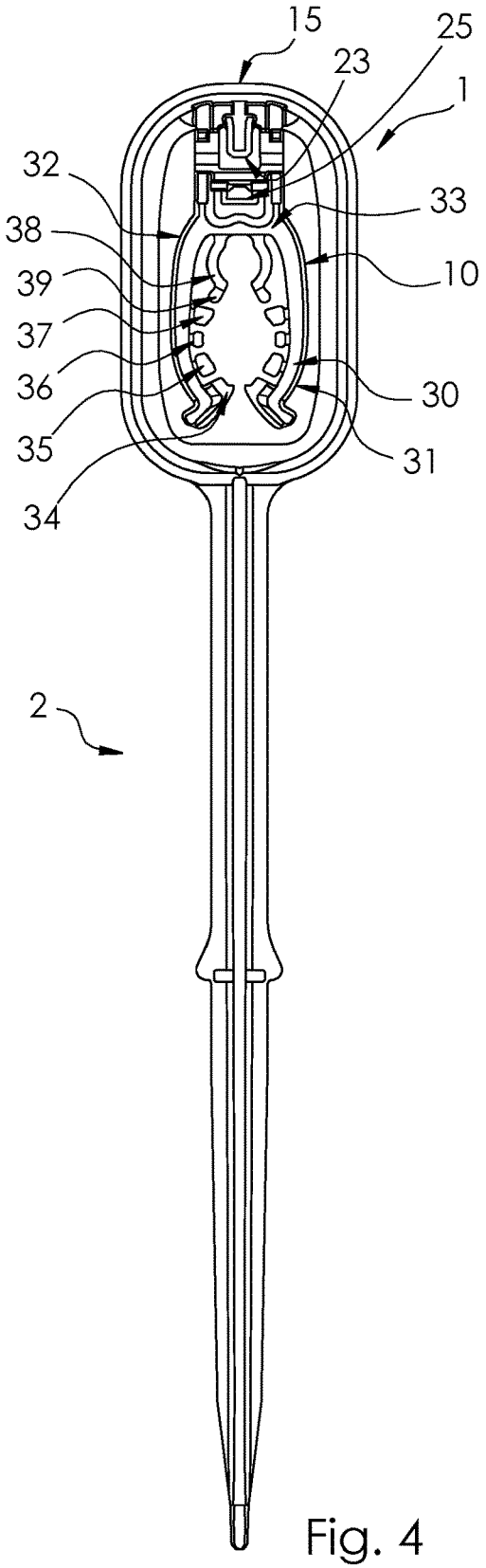
FIG. 4 is front view of the embodiment of our bulb gripper shown in FIG. 1 attached to a stake when the bulb gripper is positioned co-linear with a centerline through the stake portion.
Figure 5:
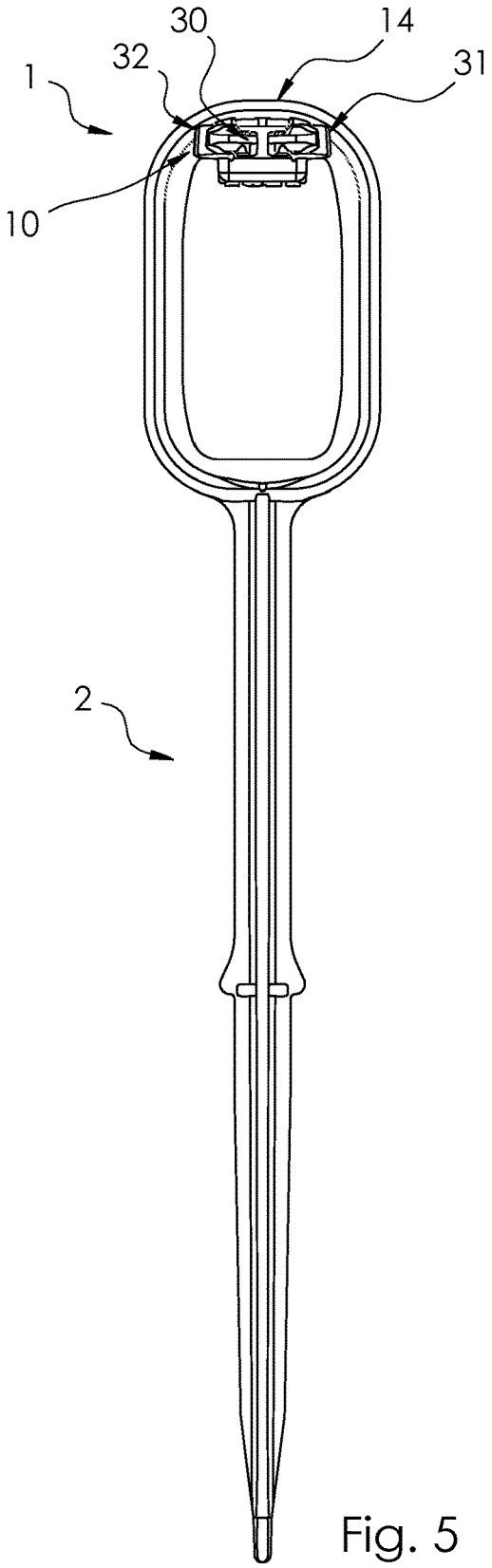
FIG. 5 is front view of the embodiment shown in FIG. 3 when the bulb gripper is positioned substantially perpendicular to a centerline through the stake portion.
Figure 6:
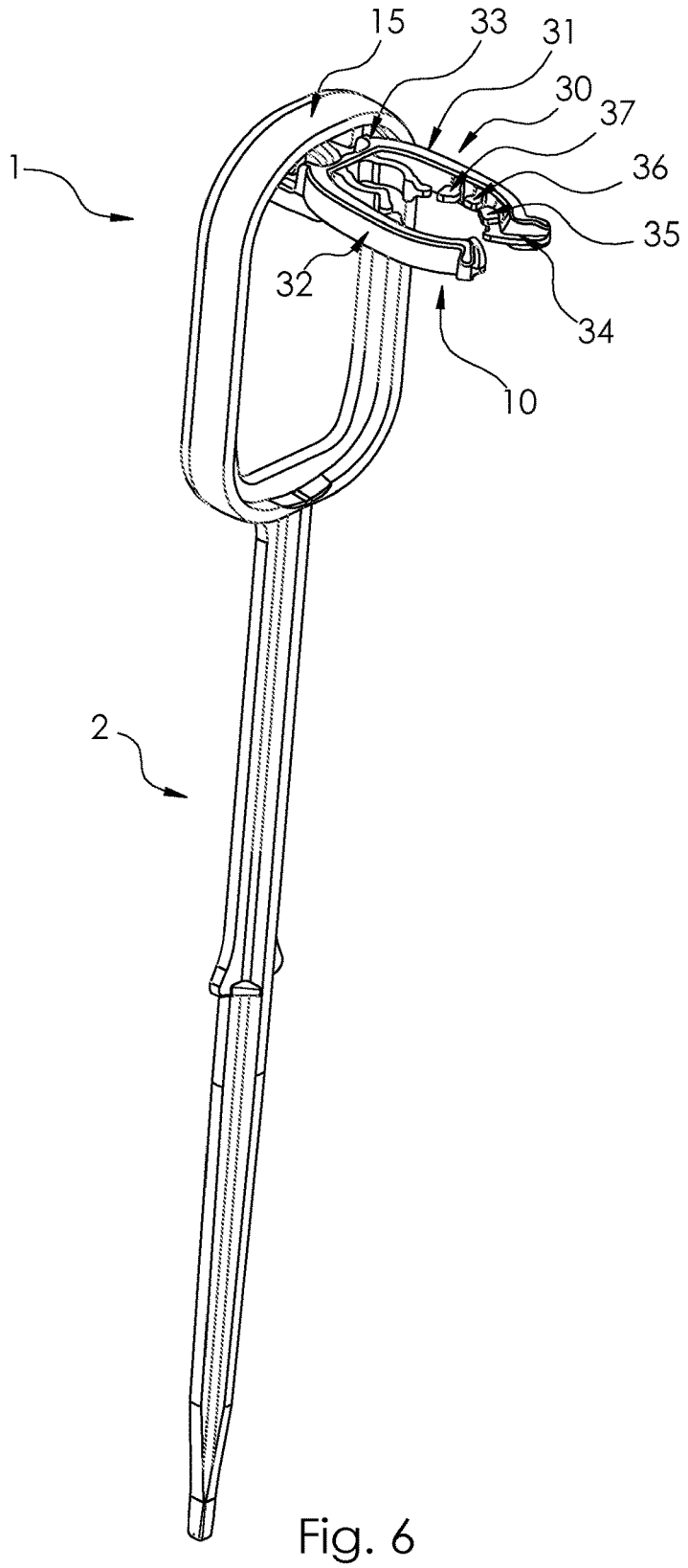
FIG. 6 is perspective view of the embodiment as shown in FIG. 5.

The bulb gripper can be attached to one of several mounting structures to enable the bulb gripper to be held at a desired location. FIGS. 4, 5 and 6 show the first embodiment of the bulb gripper attached to a stake 1. The stake shown in FIGS. 4, 5 and 6 has a top portion 15 attached to an elongated shaft 2 having a pointed end. The bulb gripper 10 is pivotably attached to the inner surface of the top 15 by a hinge 25 such that the bulb gripper can be moved from a position which is co-linear with a centerline through the stake shown in FIG. 4 to a position which is substantially perpendicular to the centerline through the stake shown in FIGS. 5, 6 and 7. The outer surface of the top portion 15 is curved and may have a series of parallel ribs that run across this surface. This configuration makes it easy to push the device into the ground.

Figure 10:
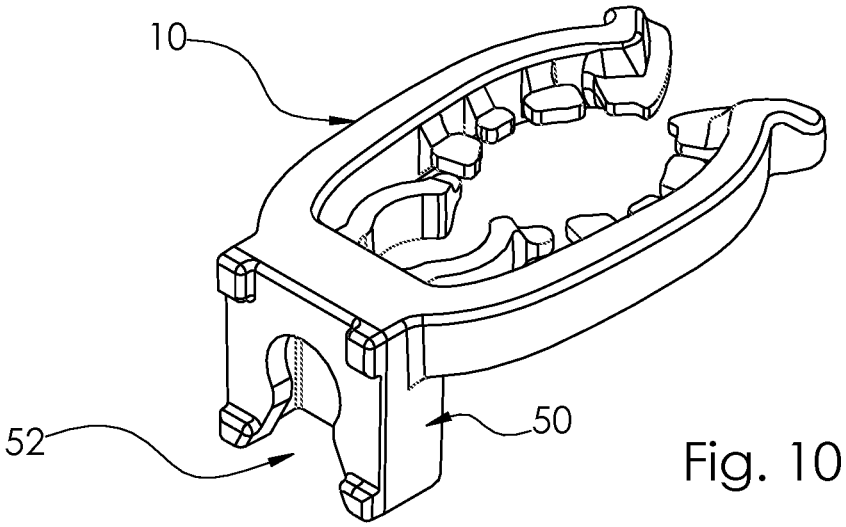
FIG. 10 is a perspective view of the embodiment as shown in FIG. 1 attached to a mounting structure that can hold the head of a suction cup.

FIG. 10 shows the first embodiment 10 attached to a mounting structure 50 having a slot 52 that is sized to receive the head of a suction cup. The suction cup can be attached to a window or mirror.

Figure 11:
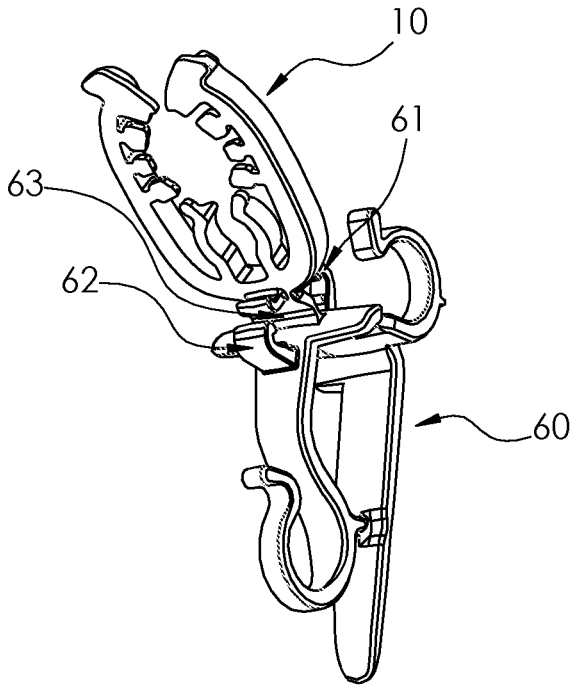
FIG. 11 is a perspective view of the embodiment as shown in FIG. 1 attached to a mounting structure which can be attached to a gutter or shingles.

FIG. 11 shows the first embodiment 10 attached to a mounting structure 60 which can be attached to a gutter or shingles. The bulb gripper is attached to the mounting structure by a hinge 63. A tab on the top of the bulb gripper can engage a first arm 61 on the housing 60 to hold the bulb gripper in a first locked position. A second tab on the bottom of the bulb gripper can engage a second arm 62 on the housing 60 to hold the bulb gripper in a second locked position.

Figure 12:
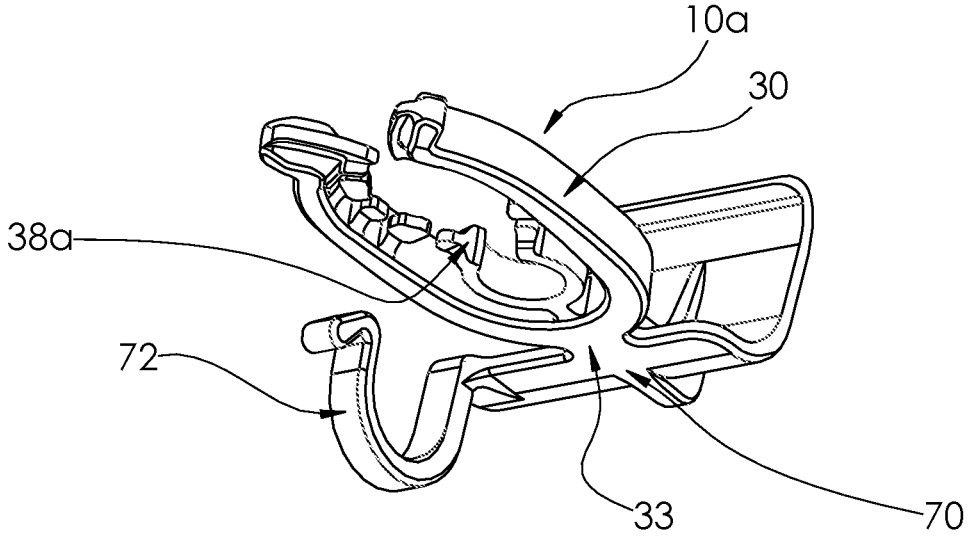
FIG. 12 is a perspective view of the embodiment as shown in FIG. 1 attached to a mounting structure which can be attached to siding.

FIG. 12 shows another embodiment of the bulb gripper 10*a*, which is similar to the first embodiment of the bulb gripper shown in FIG. 1, attached to another mounting structure 70 that can be attached to siding. In this embodiment the U-shaped mini-light holder 38*a* is connected to the base 33 of the U-shaped body 30 by a connector. The housing 70 has a hook 72 that can hold a rope light.

Preferably the decorative light holder is made entirely of plastic. We prefer to use polypropylene. But the product could be made of a comparable plastic which permits the arms in the bulb gripper to flex.

Although we have shown and described certain present preferred embodiments of our decorative light holder it should be distinctly understood that our invention is not limited thereto but may be variously embodied within the scope of the following claims.

We claim:

1. A bulb gripper for holding a decorative light comprising:

a U-shaped housing having a first arm, a second arm and a base to which the first arm and the second arm are attached, the first arm having a first inside surface, the second arm having a second inside surface;

a first set of projections on the first inside surface;

a second set of projections on the second inside surface, the first set of projections and the second set of projections being sized and configured to define a circular opening sized to receive at least one of a decorative light bulb and a socket for a decorative light bulb; and a third set of projections connected to at least one of the base of the bulb gripper, the first arm and the second arm, the third set of projections being sized and configured to define a circular opening sized to receive at least one of a decorative mini-light bulb and a socket for a decorative mini-light bulb.

2. The bulb gripper of claim 1 wherein the third set of projections define a second U-shaped housing connected to the base of the bulb gripper.

3. The bulb gripper of claim 1 also comprising a mounting structure attached to the bulb gripper, the mounting structure configured to enable the bulb gripper to be attached to at least one of a gutter, siding and shingles.

4. The bulb gripper of claim 1 wherein the first arm, the first set of projections, the second arm and the second set of projections define a ledge sized to receive a neck of a decorative light bulb.

5. The bulb gripper of claim 1 wherein the bulb gripper is comprised of polypropylene.

6. A bulb gripper for holding a decorative light comprising:

a U-shaped housing having a first arm, a second arm and a base to which the first arm and the second arm are attached, the first arm having a first inside surface, the second arm having a second inside surface;

a first set of projections on the first inside surface; and a second set of projections on the second inside surface, the first set of projections and the second set of projections being sized and configured to define a circular opening sized to receive at least one of a decorative light bulb and a socket for a decorative light bulb; wherein the at least one of the projections consists of a tab portion connected to the first arm or the second arm by a narrower connector portion.

7. A bulb gripper for holding a decorative light comprising:

a U-shaped housing having a first arm, a second arm and a base to which the first arm and the second arm are attached, the first arm having a first inside surface, the second arm having a second inside surface;

a first set of projections on the first inside surface;

a second set of projections on the second inside surface, the first set of projections and the second set of projections being sized and configured to define a circular opening sized to receive at least one of a decorative light bulb and a socket for a decorative light bulb;

a first inward tooth attached to the first arm of the U-shaped body; and a second inward tooth attached to the second arm of the U-shaped body;

each tooth having a sliver that extends outward to engage a decorative light prior to and then during insertion of the decorative light into the bulb gripper.

* * * * *